US008082738B2

(12) United States Patent
Cornelius et al.

(10) Patent No.: US 8,082,738 B2
(45) Date of Patent: Dec. 27, 2011

(54) DIFFUSER ARRANGED BETWEEN THE COMPRESSOR AND THE COMBUSTION CHAMBER OF A GAS TURBINE

(75) Inventors: Christian Cornelius, Sprockhövel (DE); Reinhard Mönig, Königswinter (DE); Peter Tiemann, Witten (DE); Iris Oltmanns, legal representative, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 1039 days.

(21) Appl. No.: 10/568,736

(22) PCT Filed: Jul. 16, 2004

(86) PCT No.: PCT/EP2004/007946

§ 371 (c)(1),
(2), (4) Date: Apr. 10, 2009

(87) PCT Pub. No.: WO2005/019621

PCT Pub. Date: Mar. 3, 2005

(65) Prior Publication Data

US 2010/0257869 A1 Oct. 14, 2010

(30) Foreign Application Priority Data

Aug. 18, 2003 (EP) ..... 03018565

(51) Int. Cl.
*F02C 1/00* (2006.01)

(52) U.S. Cl. ..... 60/751

(58) Field of Classification Search ..... 60/39.37, 60/751, 758, 760, 782, 796; 415/207
See application file for complete search history.

(56) References Cited

U.S. PATENT DOCUMENTS

| | | | | | |
|---|---|---|---|---|---|
| 2,541,170 | A | * | 2/1951 | Mayers et al. | 60/751 |
| 3,631,674 | A | * | 1/1972 | Taylor | 60/804 |
| 4,194,359 | A | * | 3/1980 | Brookman et al. | 60/804 |
| 4,297,842 | A | * | 11/1981 | Gerhold et al. | 60/776 |
| 4,796,429 | A | * | 1/1989 | Verdouw | 60/751 |
| 5,077,967 | A | * | 1/1992 | Widener et al. | 60/772 |
| 5,134,855 | A | * | 8/1992 | Belcher et al. | 60/751 |
| 5,197,289 | A | * | 3/1993 | Glevicky et al. | 60/746 |
| 5,269,133 | A | | 12/1993 | Wallace | |
| 5,555,721 | A | * | 9/1996 | Bourneuf et al. | 60/806 |
| 5,557,921 | A | | 9/1996 | Frutschi et al. | |
| 5,592,821 | A | * | 1/1997 | Alary et al. | 60/751 |
| 6,334,297 | B1 | * | 1/2002 | Dailey et al. | 60/785 |
| 7,062,918 | B2 | * | 6/2006 | Walker et al. | 60/751 |
| 2003/0010014 | A1 | | 1/2003 | Bland et al. | |
| 2004/0231333 | A1 | * | 11/2004 | Tiemann | 60/730 |

FOREIGN PATENT DOCUMENTS

| | | | |
|---|---|---|---|
| DE | 195 44 927 | A1 | 4/1997 |
| DE | 196 39 623 | A1 | 4/1998 |

* cited by examiner

*Primary Examiner* — Louis Casaregola
*Assistant Examiner* — Phutthiwat Wongwian

(57) ABSTRACT

A gas turbine engine having an axial flow compressor, an annular combustion chamber, a turbine, and a diffuser. The diffuser includes a flow-dividing element formed by an inner deflecting flank and an outer deflecting flank that divides a compressed gas flow into two partial flows at a branching point. The two deflecting flanks define: an angle of less than 90° along at least a portion of the deflecting flanks, and an angle between 15° and 90° between the deflecting flank angle bisector and the turbine longitudinal axis. The deflector also includes a main deflecting region arranged upstream of the branching point and directed at an acute angle from the turbine longitudinal axis toward an inner combustion chamber shell.

18 Claims, 2 Drawing Sheets

DIFFUSER ARRANGED BETWEEN THE COMPRESSOR AND THE COMBUSTION CHAMBER OF A GAS TURBINE

CROSS REFERENCE TO RELATED APPLICATIONS

This application is the US National Stage of International Application No. PCT/EP2004/007947, filed Jul. 16, 2004 and claims the benefit thereof. The International Application claims the benefits of European Patent application No. 03018565.6 EP filed Aug. 18, 2003. All of the applications are incorporated by reference herein in their entirety.

FIELD OF THE INVENTION

The invention relates to a gas turbine having an annular combustion chamber and a diffuser which is arranged upstream of the latter, can be subjected to flow essentially parallel to a turbine longitudinal axis and is at a smaller distance from the latter than the annular combustion chamber and in which a compressed gas can be divided into partial flows at a branching point.

BACKGROUND OF THE INVENTION

Gas turbines are used in many sectors for driving generators or driven machines. In this case, the energy content of a fuel is used for producing a rotary movement of a turbine shaft. To this end, the fuel is burned in a combustion chamber, in the course of which air compressed by an air compressor is supplied. The working medium which is produced in the combustion chamber by the combustion of the fuel and is under high pressure and high temperature is directed in the process via a turbine unit, where it expands to perform work, arranged downstream of the combustion chamber.

In addition to the output which can be achieved, and in addition to a compact type of construction, an especially high efficiency is normally a design aim when designing such gas turbines. In this case, for thermodynamic reasons, an increase in the efficiency can in principle be achieved by an increase in the outlet temperature with which the working medium flows out of the combustion chamber and into the turbine unit. Temperatures of about 1200° C. up to 1300° C. are therefore aimed at and are also achieved for such gas turbines.

At such high temperatures of the working medium, however, the components exposed to said working medium are subjected to high thermal loads. In order to nonetheless ensure a comparatively long service life of the relevant components with high reliability, cooling of the relevant components, in particular of moving and guide blades of the turbine unit, is normally provided. Furthermore, provision can be made to cool the combustion chamber with cooling medium, in particular cooling air.

DE 195 44 927 A1 discloses a gas turbine which has an air compressor arranged upstream of a combustion chamber and opening into a diffuser. In the diffuser, a partial flow of the compressed air can be branched off from said diffuser and used for cooling structural parts, for example turbine blades of the gas turbine. However, the branching-off of the cooling air from the diffuser is only suitable for branching off a relatively small partial flow from the air flow leaving the air compressor. On the other hand, the main air flow directed through the diffuser is deflected in the direction of the combustion chamber and fed to the latter as combustion air. It is thus likely that components arranged downstream of the diffuser, i.e. relative to the direction of flow of the working medium flowing through the turbine, can only be cooled to a restricted extent.

Furthermore, DE 196 39 623 discloses a gas turbine which has a diffuser and in which the cooling air is bled by means of a tube projecting into the outlet of the diffuser. The compressed air used for combustion in an annular combustion chamber is in this case diverted in the direction of the burner by means of a C-shaped plate. Both during the bleeding of the cooling air and during the directing of the burner air, flow losses may occur, which it is necessary to avoid.

SUMMARY OF THE INVENTION

The object of the invention is to specify a gas turbine which is equipped with an annular combustion chamber and which enables the compressor air to be directed in a fluidically favorable manner for an especially uniform and effective cooling capacity of thermally loaded components.

This object is achieved according to the invention by a gas turbine having the features of the claims. In this case, the gas turbine has an annular combustion chamber and an annular diffuser which is arranged downstream of the latter and at least partly between the turbine longitudinal axis and the annular combustion chamber. In the diffuser, which can be subjected to flow essentially parallel to the turbine longitudinal axis, a compressed gas can be divided into a plurality of partial flows. According to the invention, the diffuser has a main deflecting region which is directed at an acute angle pointing away from the turbine longitudinal axis toward the inner wall of the annular combustion chamber. Arranged downstream of the main deflecting region in the direction of the gas, in particular air, flowing through the diffuser is a branching point at which the gas flowing through the diffuser can be divided into partial flows by means of a flow-dividing element. The annular flow-dividing element of wedge-shaped cross section is arranged between the two diverging walls of the diffuser—the inner wall lying radially on the inside and the outer wall lying radially further on the outside. Two deflecting flanks opposite the walls of the diffuser converge at an acute angle and meet at the branching point. There, they enclose an angle bisector which intersects the turbine longitudinal axis at an acute dividing angle greater than 15°.

As viewed in the axial direction, the main deflecting region is arranged downstream of the compressor and upstream of the annular combustion chamber, whereas the flow-dividing element is arranged between the annular combustion chamber and the turbine longitudinal axis. For the gas turbine, this geometry permits a compact design which in particular is shortened in the axial direction. Furthermore, the flow losses in the compressed partial flows of cooling medium are reduced.

An especially good cooling capacity of components, in particular of the annular combustion chamber, which are at a radial distance from the turbine longitudinal axis is achieved by the gas flow which flows through the diffuser being directed with a component directed toward the annular combustion chamber. The two partial flows divided in the diffuser are preferably then also used for the combustion.

In an advantageous development, the outer wall of the diffuser and the outer deflecting flank, opposite said outer wall, of the flow-dividing element run behind the branching point approximately perpendicularly to the turbine longitudinal axis. This ensures low-loss feeding of the outer partial flow to the outer flow transfer space. Short and direct feeding of the partial flow is accordingly achieved.

In gas turbines having a combustion chamber not designed as an annular combustion chamber, e.g. in gas turbines having "can combustion chambers", the supplying of the outer combustion chamber shell is fairly simple. In gas turbines having can combustion chambers, the individual can-shaped combustion chambers are at a distance from one another in the circumferential direction on a ring concentrically enclosing the turbine longitudinal axis. The feeding of the cooling air to the radially outer combustion chamber shells can then be effected between the individual can combustion chambers.

Furthermore, low-loss feeding of the inner partial flow to the inner flow transfer space is ensured by the inner wall of the diffuser and the deflecting flank, opposite said inner wall, of the flow-dividing element running approximately parallel to the turbine longitudinal axis. From the compressor outlet up to the flow transfer space, wavelike directing is proposed for the inner partial flow, this wavelike directing, compared with rectilinear directing, achieving an improvement over rectilinear directing with regard to the pressure losses and the flow losses in the partial flow.

According to a preferred configuration, the compressed gas, which leaves the diffuser at the branching point, is directed at the latter directly into the flow transfer space, which produces the fluidic connection to the wall cooling space of the annular combustion chamber. The flow transfer space preferably adjoins the combustion chamber wall on the outside, so that additional cooling of the combustion chamber wall is thereby achieved.

The annular combustion chamber is preferably of closed coolable design. In this case, combustion air, as cooling medium, is preferably directed through a wall space of the annular combustion chamber in counterflow to the flue gas. The combustion air flowing through the combustion chamber wall is in this case preferably identical at least to a partial flow of the compressed air which has flowed through the diffuser beforehand. The air flowing through the diffuser is preferably fed completely as cooling air to the wall of the annular combustion chamber and further as combustion air to the annular combustion chamber. In this case, the dividing of the air flow at the branching point of the diffuser serves to supply a plurality of parts of the annular combustion chamber, for example an inner shell or an outer shell, uniformly with cooling air.

Provided the annular combustion chamber has an essentially flat combustion chamber rear wall, at least in one section, the expression "wall angle" of the annular combustion chamber refers to that angle which the combustion chamber rear wall encloses with the turbine longitudinal axis. Especially uniform all-over cooling of the combustion chamber wall is preferably achieved by the dividing angle of the flow-dividing element deviating from the wall angle of the combustion chamber rear wall by not more than 20°, in particular by not more than 15°.

A tube communicating with the bottom sectional passage is preferably provided in order to bleed cooling air for the turbine. As a result, further dividing of the compressor air flow can be effected. If the tube projects into the bottom sectional passage, and its tube opening faces the flow, the turbine cooling air is tapped in an especially favorable manner.

The advantage of the invention lies in particular in the fact that air which is compressed in a gas turbine and which serves as cooling air and then as combustion air is fed with a low pressure loss from an air compressor through a compact diffuser to the annular combustion chamber, a flow-dividing element at the outlet of the diffuser producing a uniform admission of cooling air to the annular combustion chamber.

BRIEF DESCRIPTION OF THE DRAWINGS

An exemplary embodiment of the invention is explained in more detail with reference to a drawing, in which.

Parts corresponding to one another are provided with the same reference numerals in both figures.

DETAILED DESCRIPTION OF THE INVENTION

Figure 1:
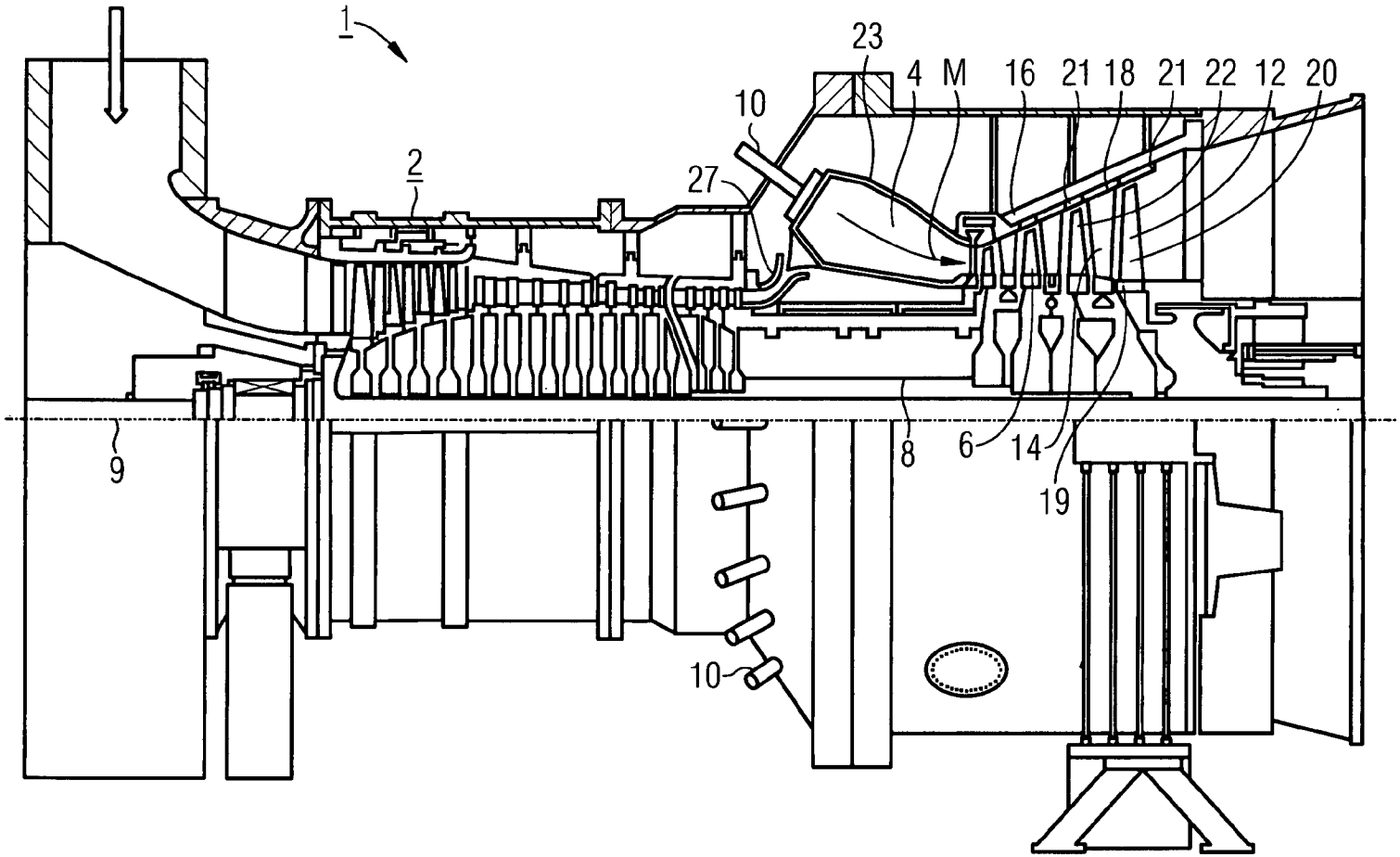
FIG. 1 shows a half section of a gas turbine.

The gas turbine 1 according to FIG. 1 has a compressor 2 for combustion air, an annular combustion chamber 4 and a turbine 6 for driving the compressor 2 and a generator (not shown) or a driven machine. To this end, the turbine 6 and the compressor 2 are arranged on a common turbine shaft 8, which is also designated as turbine rotor, and to which the generator or the driven machine is also connected, and which is rotatably mounted about its center axis 9.

The annular combustion chamber 4 is fitted with a number of fuel injectors 10 for burning a liquid or gaseous fuel. Furthermore, it is provided with a wall lining 24 at its combustion chamber wall 23.

The turbine 6 has a number of rotatable moving blades 12 connected to the turbine shaft 8. The moving blades 12 are arranged in a ring shape on the turbine shaft 8 and thus form a number of moving blade rows. Furthermore, the turbine 6 comprises a number of fixed guide blades 14, which are likewise fastened in a ring shape to an inner casing 16 of the turbine 6 while forming moving blade rows. The moving blades 12 serve in this case to drive the turbine shaft 8 by impulse transmission of the flue, gas or working medium M flowing through the turbine 6. The guide blades 14, on the other hand, serve to direct the flow of the working medium M between in each case two successive moving blade rows or moving blade rings as viewed in the direction of flow of the working medium M. A successive pair consisting of a ring of guide blades 14 or a guide blade row and of a ring of moving blades 12 or a moving blade row is designated in this case as a turbine stage.

Each guide blade 14 has a platform 18, which is also designated as blade root 19 and is intended for fixing the respective guide blade 14 in the gas turbine 1. Each moving blade 12 is fastened to the turbine shaft 8 in a similar manner via a blade root 19 also designated as platform 18, the blade root 19 in each case carrying a profiled airfoil 20 extended along a blade axis.

Between the platforms 18, arranged at a distance apart, of the guide blades 14 of two adjacent guide blade rows, a respective guide ring 21 is arranged on the inner casing 16 of the turbine 6. The outer surface of each guide ring 21 is in this case likewise exposed to the hot working medium M flowing through the turbine 6 and is at a radial distance from the outer end 22 of the moving blade 12 lying opposite it with a gap in between. In this case, the guide rings 21 arranged between adjacent guide blade rows serve in particular as cover elements which protect the inner wall 16 or other built-in casing components from thermal overstressing by the hot working medium M flowing through the turbine 6.

To achieve a comparatively high efficiency, the gas turbine 1 is designed for a comparatively high discharge temperature of about 1200° C. to 1300° C. of the working medium M discharging from the annular combustion chamber 4.

The combustion chamber wall 23 can be cooled with cooling air, as cooling medium K, compressed in the compressor 2. Between the combustion chamber wall 23 and the wall lining 24, cooling air K flows to the fuel injector 10 in a wall space or wall lining space 26 in counterflow to the working medium M. The cooling air K, which also serves as combustion air, is directed from the compressor 2 through a diffuser 27 in the direction of the annular combustion chamber 4. By means of the diffuser 27, the cooling and combustion air K, divided in a defined manner, is fed to an outer combustion chamber shell 28 on the one hand and to an inner combustion chamber shell 29 on the other hand.

Figure 2:
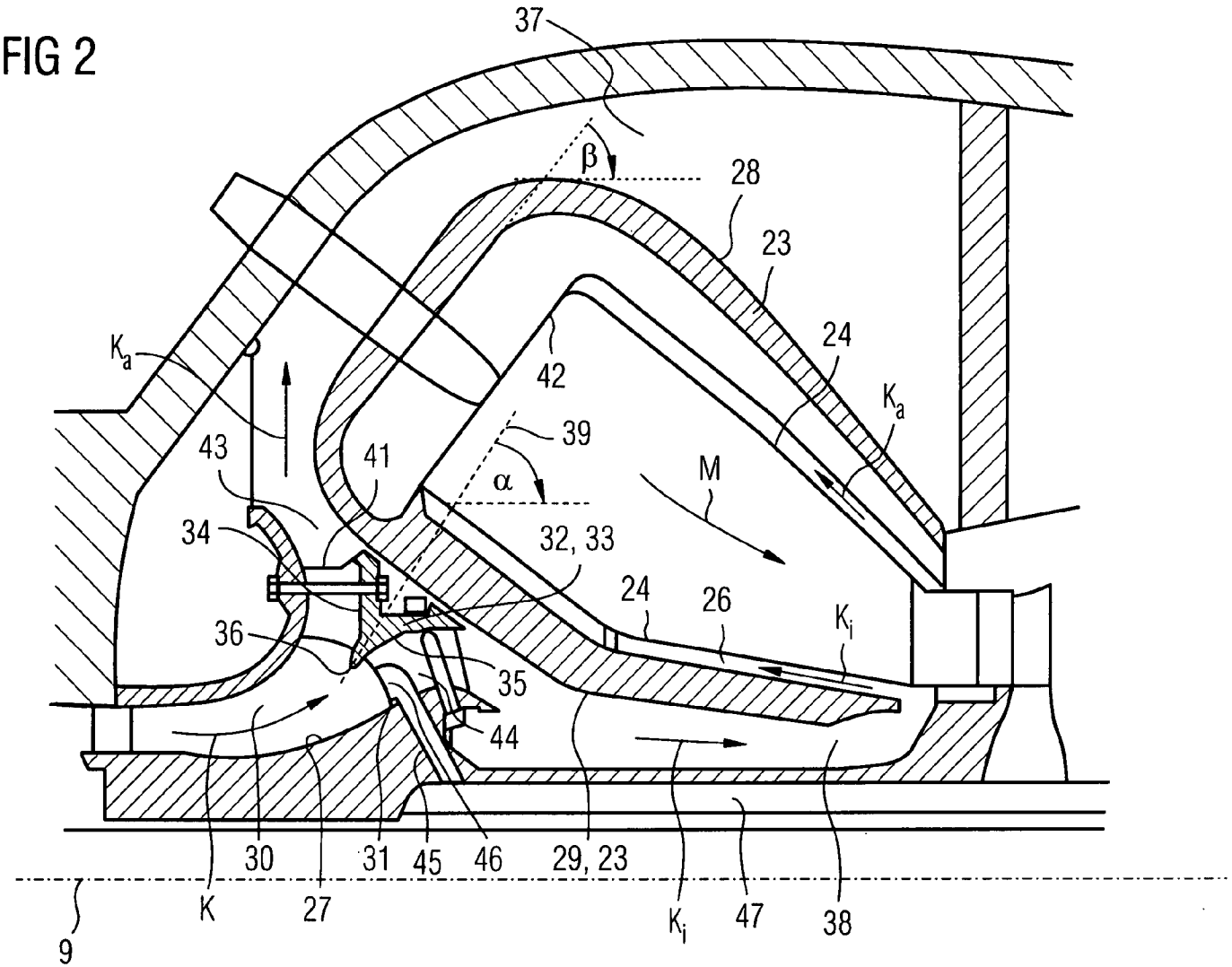
FIG. 2 shows a diffuser and an annular combustion chamber of the gas turbine according to FIG. 1, in cross section.

The directing of the flow of the cooling air K through the diffuser 27 is shown in detail in FIG. 2. The diffuser 27 has a main deflecting region 30, which adjoins the compressor 2. The compressed cooling air K flows out of the compressor 2 parallel to the center axis or turbine longitudinal axis 9 and into the main deflecting region 30 of the diffuser 27. The main deflecting region 30, arranged between the compressor 2 and the annular combustion chamber 4 as viewed in the axial direction, of the diffuser 27 runs radially outward with widening cross section, i.e. away from the turbine longitudinal axis 9. In this way, the flow velocity of the compressed gas used as cooling air K is reduced in the main deflecting region 30. Provided a separation of flow occurs at the inner wall and outer wall of the diffuser 27, such a separation occurs only at a low flow velocity and correspondingly low pressure loss.

A flow-dividing element 32 is arranged at the downstream end 31, with respect to the cooling air K, of the main deflecting region 30 in such a way as to adjoin the outer combustion chamber shell 29.

The flow-dividing element 32 arranged between the annular combustion chamber 4 and the turbine longitudinal axis 9 has an approximately triangular shape, also designated as dividing fork 33, having an outer deflecting flank 34 and an inner deflecting flank 35. The deflecting flanks 34, 35 converge at a dividing tip 36 directed toward the main deflecting region 30 and enclose an acute angle of less 90°, in particular an angle of 60°, at the dividing tip 36. The dividing tip or edge 36, which forms a branching point, divides the cooling air K flowing through the main deflecting region 30 of the diffuser 27 approximately uniformly into an outer cooling air flow $K_a$ and an inner cooling air flow $K_i$. The outer cooling air flow $K_a$ is directed through an outer flow transfer space 37 to an outer combustion chamber shell 28, whereas the inner cooling air flow $K_i$ is directed via an inner flow transfer space 38 to the inner combustion chamber shell 29.

The diffuser 27 dividing the cooling air K at the flow-dividing element 32 is also designated as split diffuser. The cooling air K flowing through the main deflecting region 30 is deflected radially approximately in a C shape, relative to the turbine longitudinal axis 9, outward up to the dividing tip 36 of the flow-dividing element 32. A straight line running as angle bisector 39 between the curved deflecting flanks 34, 35 through the dividing tip 36 encloses a dividing angle a of about 45° with the turbine longitudinal axis 9. The angle bisector 39 encloses an approximately right angle with the bottom combustion chamber shell 29. The inner cooling air flow $K_i$, starting from the dividing tip 36, is forced first of all into a horizontal direction of flow, i.e. parallel to the turbine longitudinal axis 9, by the inner deflecting flank 35 and is directed further radially inward again, i.e. toward the turbine longitudinal axis 9, by the outside of the combustion chamber wall 23. The inner cooling air flow $K_i$ is therefore directed, first of all still within the cooling air K undivided in the main deflecting region 30, radially outward in a path curved approximately in a C shape and is decelerated in the process and then directed radially inward in a path curved in the opposite direction approximately in a C shape. Overall, the flow through the diffuser 27 and further into the inner flow transfer space 38 approximately describes a double S-shaped path. The radii of curvature within this path are sufficiently large in order to cause only small energy losses during the flow.

Furthermore, baffle elements or fastening elements 41 are arranged at the downstream end 31 of the diffuser 27 in both the direction of the outer flow transfer space 37 and the direction of the inner flow transfer space 38.

The outer cooling air flow $K_a$ is directed radially outward, perpendicularly to the turbine longitudinal axis 9, by the dividing fork 33. In continuation, the outer cooling air flow $K_a$ is directed past the outer combustion chamber shell 28 and into the wall lining space or wall cooling space 26. Here, too, in a similar manner to the inner cooling air flow $K_i$, the flow is directed with large radii of curvature, in the course of which no abrupt widening of cross section occurs. The combustion chamber shells 28, 29 are cooled from outside by the cooling air flows or partial flows $K_a$, $K_i$.

The fuel injector 10 is arranged approximately centrally in the combustion chamber rear wall 42. A straight line running through the combustion chamber rear wall 42 encloses a wall angle βof about 45° with the turbine longitudinal axis 9. The wall angle βthus corresponds approximately to the dividing angle α. The flow-dividing element 32 arranged obliquely relative to the turbine longitudinal axis 9 by the dividing angle a splits the main deflecting region 30 into a top sectional passage 43 and a bottom sectional passage 44, which both have approximately the same cross section. The cooling air flow in the diffuser 27 can be divided in a specifically asymmetrical manner by a laterally offset arrangement of the flow-dividing element 32, i.e. by an arrangement offset along the inner combustion chamber shell 29, if, for example, the outer combustion chamber shell and the inner combustion chamber shell 29 have a different cooling air requirement.

The bleeding for turbine cooling air is effected by a tube 45 which projects into the bottom sectional passage 44. The end 46 of said tube 45 is angled like a periscope, and its tube opening faces the inner air flow $K_i$, so that some of the air flow $K_i$ can flow as turbine cooling air into the tube 45. At the other end of the tube 45, the turbine cooling air flows into an annular passage 47 which extends along the rotor and directs the turbine cooling air to the turbine 6. It is used there for cooling the moving and the guide blades 12, 14.

The invention claimed is:

1. A gas turbine engine, comprising:

an axial flow compressor arranged along a longitudinal axis of a turbine that produces a compressed gas flow;

an annular combustion chamber inclined radially inward in a downstream direction and having a rear wall segment inclined at a wall angle of at least 30° relative to the turbine longitudinal axis;

a turbine that extracts mechanical energy from the compressed gas flow; and a diffuser located along the turbine longitudinal axis adapted to channel the gas flow from the compressor to the combustion chamber, comprising:

a flow-dividing element formed by an inner deflecting flank and an outer deflecting flank that divides the compressed gas flow into two partial flows at a branching point, wherein a direction of each partial flow is changed by a respective deflecting flank, the two deflecting flanks defining:

a tip angle of less than 90° along portions of the deflecting flanks that meet at a flow-dividing element tip, wherein the flow-dividing element tip defines the branching point, and a dividing angle between 15° and 90° between a tip angle bisecting line and the turbine longitudinal axis;

a main deflecting region arranged upstream of the branching point and directed at an acute angle from the turbine longitudinal axis toward an inner combustion chamber shell.

2. The gas turbine as claimed in claim 1, wherein a fuel injector is centrally located on the wall segment.

3. The gas turbine as claimed in claim 1, wherein the diffuser is concentrically located along the turbine longitudinal axis.

4. The gas turbine as claimed in claim 1, wherein the flow-dividing element is wedge-shaped.

5. The gas turbine as claimed in claim 1, wherein the two deflecting flanks define an angle of less than 90° along entire lengths of the deflecting flanks.

6. The gas turbine as claimed in claim 1, wherein a radially outer partial flow defined by the outer deflecting flank and an outer wall opposite the outer deflecting flank extends beyond the branching point perpendicular to the turbine longitudinal axis.

7. The gas turbine as claimed in claim 1, wherein a radially inner partial flow defined by the inner deflecting flank and an inner wall opposite the inner deflecting flank extends beyond the branching point parallel to the turbine longitudinal axis.

8. The gas turbine as claimed in claim 7, wherein the radially inner partial flow is directed obliquely in the direction of the turbine longitudinal axis after exiting the diffuser.

9. The gas turbine as claimed in claim 1, wherein the annular combustion chamber has an inner combustion chamber wall and an outer combustion chamber wall that form a wall cooling space.

10. The gas turbine as claimed in claim 9, wherein a flow transfer space adjoins the annular combustion chamber and connects the diffuser to the wall cooling space.

11. The gas turbine as claimed claim 1, wherein the annular combustion chamber is a closed cooled annular combustion chamber.

12. The gas turbine as claimed claim 9, wherein the wall cooling space receives the two partial flows and delivers them to the combustion chamber in a direction counter to a direction of flow of combustion gasses.

13. The gas turbine as claimed in claim 1, wherein the dividing angle deviates from the wall angle by not more than 20°.

14. The gas turbine as claimed in claim 7, wherein the turbine is cooled by bleeding-off cooling air from the inner partial flow via a bleed air tube that is in communication with a bottom sectional passage disposed between the inner deflecting flank and the inner wall.

15. The gas turbine as claimed in claim 14, wherein the turbine bleed air tube projects into the bottom sectional passage and its tube opening faces the flow.

16. A compressor diffuser assembly for an axial flow gas turbine engine, comprising:

an outer wall that defines an outer most surface of the diffuser assembly flow path;

a wedge-shaped flow-dividing element comprising:

an inner deflecting flank and an outer deflecting flank that divides the compressed gas into two partial flows at a branching point, wherein a direction of each partial flow is changed by a respective deflecting flank, the two deflecting flanks defining:

a tip angle of less than 90° along at least a portion of the deflecting flanks that meet at a flow-dividing element tip, and a dividing angle between 15° and 90° between a tip angle bisecting line and the gas turbine engine longitudinal axis, wherein a main deflecting region is located within the outer wall and upstream of the branching point and is oriented at an acute angle away from the diffuser longitudinal axis;

a plurality of baffle elements each spanning between the outer wall and the flow dividing element; and a plurality of fastening elements that interconnect/attach the outer wall, the baffle elements and the flow dividing element.

17. The diffuser as claimed in claim 16, wherein the outer deflecting flank and an outer wall opposite the outer deflecting flank extend beyond the branching point perpendicular to the turbine longitudinal axis and the inner deflecting flank and an inner wall opposite the inner deflecting flank, extends beyond the branching point parallel to the turbine longitudinal axis.

18. The diffuser as claimed in claim 16, wherein the fastening elements are bolts and nuts.

* * * * *